United States Patent [19]

Blease

[11] 4,360,123

[45] Nov. 23, 1982

[54] CONTAINER ASSEMBLY HAVING LOCKING MEANS

[75] Inventor: Wilfred J. Blease, Greenville, N.H.

[73] Assignee: Pioneer Plastics, Inc., Greenville, N.H.

[21] Appl. No.: 256,897

[22] Filed: Apr. 23, 1981

Related U.S. Application Data

[63] Continuation-in-part of Ser. No. 164,580, Jun. 30, 1980, abandoned.

[51] Int. Cl.[3] ..... B65D 41/06; B65D 45/00; B65D 45/28

[52] U.S. Cl. ..... 220/323; 220/293; 220/318

[58] Field of Search ..... 220/315, 318, 323, 293, 220/294

[56] References Cited

U.S. PATENT DOCUMENTS

| | | | |
|---|---|---|---|
| 2,772,809 | 12/1956 | Ross | 220/323 |
| 2,875,918 | 3/1959 | Baumier | 220/323 |
| 4,132,327 | 1/1979 | Van Dyke | 220/323 |
| 4,150,760 | 4/1979 | d'Orgelys | 220/323 |

*Primary Examiner*—William Price

[57] ABSTRACT

A container assembly comprises an open top container and a cover adapted to be aligned and releasably locked on top of the lower container. The lower container has outwardly extending opposed grooves in its inner side walls and the cover has a locking member mounted in its central opening and movable between unlocked and locked positions for releasably locking the cover in aligned position on top of the lower container. The locking member has a pair of opposed outwardly extending flanges cooperating with the bottom container opposed grooves for locking the cover and the lower container upon rotation of the locking member. A handle is mounted on the locking member above the cover for rotating the locking member between its unlocked and locked positions.

8 Claims, 5 Drawing Figures

FIG 1
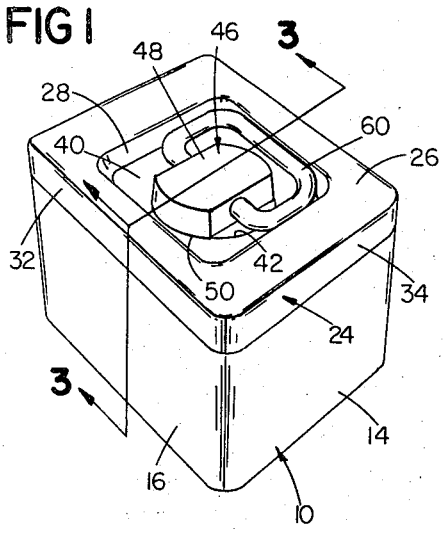
FIG 3
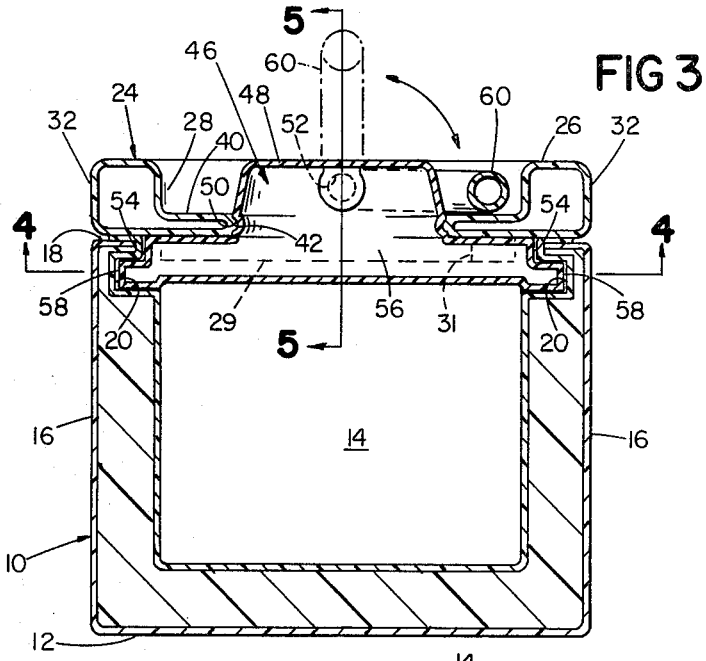
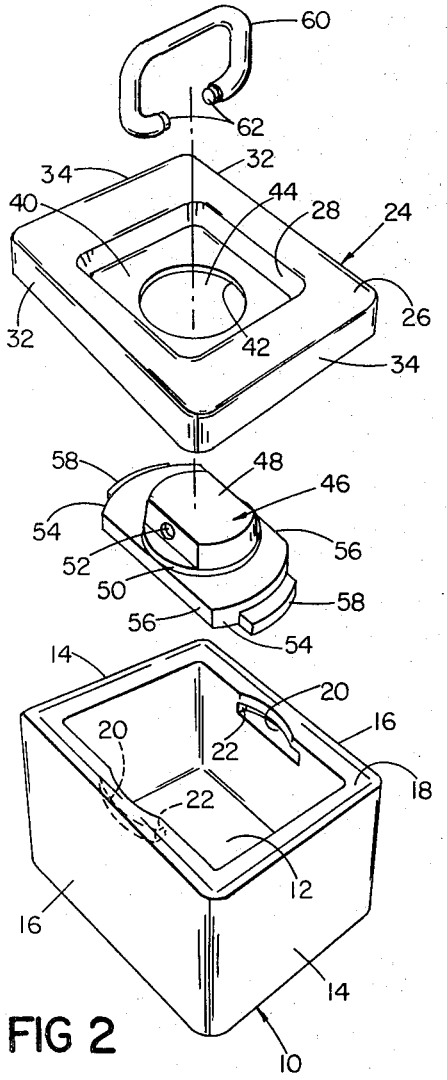
FIG 2
FIG 4
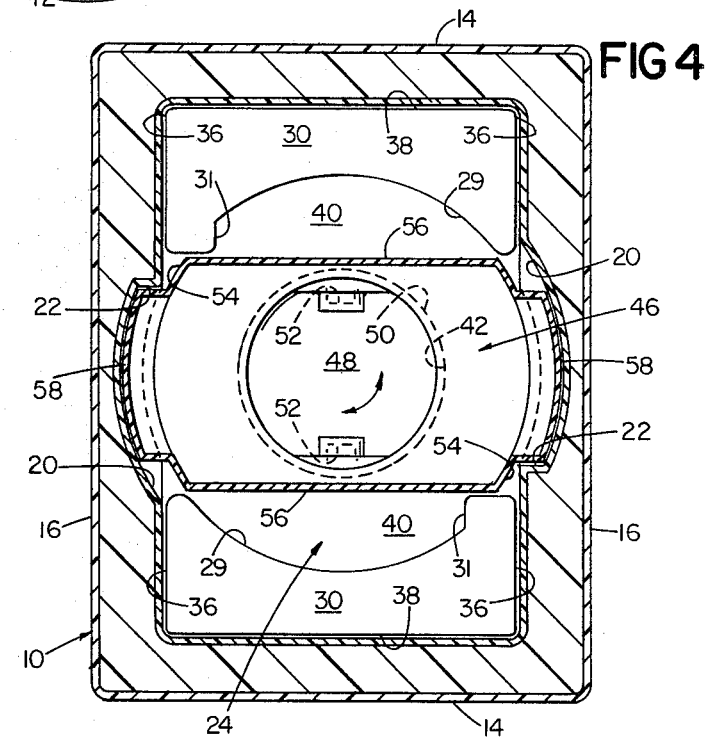
FIG 5
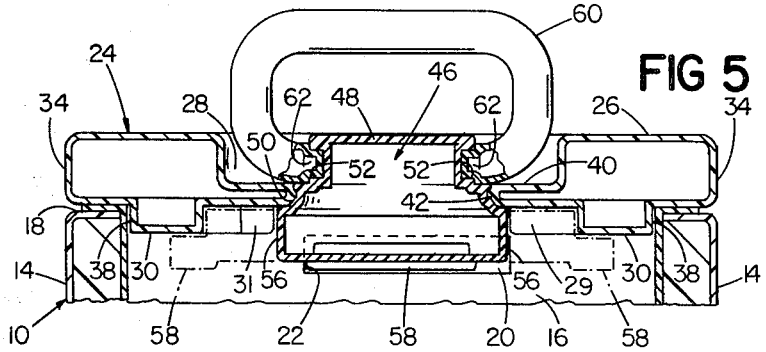

CONTAINER ASSEMBLY HAVING LOCKING MEANS

This application is a continuation-in-part of my application Ser. No. 164,580, filed June 30, 1980, now abandoned. Its invention relates to container assemblies.

In my earlier application is shown and described a dual container assembly providing two separate containers for carrying a different material in each container and having novel internal locking means integral with the two containers. Although the locking means of that application can be adapted to a container assembly having but a single container with a cover, there are certain commercial advantages to providing a container and cover assembly of more conventional flat top appearance and operation, while at the same time providing one which can be economically manufactured.

Accordingly, it is a major object of the invention to provide a novel container assembly of conventional flat top appearance which can be economically manufactured.

In order to accomplish the above and still further objects and features, the present invention provides a novel container assembly comprising an open top lower container and a cover, preferably integral and of organic plastic material, adapted to be aligned and releasably locked on top of the lower container with the peripheral outer portion of the cover bottom surface in contact with the lower container peripheral top wall in the aligned position of the cover.

The lower container is preferably thermally insulated and has a bottom wall, end and side walls, and a peripheral top wall defining a central top opening. The inner surfaces of the side walls have outwardly extending opposed grooves spaced downwardly from and parallel to the plane of the top wall.

The cover has top and bottom surfaces with side and end surfaces extending therebetween and an inner circular surface defining a central opening extending between the cover top and bottom surfaces. Aligning means are provided for aligning the cover on top of the container. A locking member rotatably movable between unlocked and locked positions is provided for releasably locking the cover in aligned position on top of the lower container. The locking member has an upper circular mounting portion and a lower locking flange portion. The upper circular locking member mounting portion is rotatably mounted within the cover central opening and extends upwardly through it. The lower locking flange portion has a pair of opposed outwardly extending flanges parallel to and spaced downwardly from the cover bottom surface for cooperating with the bottom container opposed grooves for locking of the cover and the lower container upon rotation of the locking member relatively to the cover and container in a plane parallel to the plane of the lower container peripheral top wall and the cover bottom surface between an unlocked position with the flanges disengaged from the grooves and a locked position with the flanges received within the grooves.

Retaining means is provided for normally preventing relative axial movement of the cover and locking member and may comprise cooperating circular groove and rib means on the cover and locking member circular walls providing snap-in assembly of the locking member within the cover central opening.

Stop means is also provided for preventing further locking member rotation from its unlocked position in the direction opposite to its locking direction and further rotation from its locked position in said locking direction and may comprise abutment means on the bottom wall of the cover and adjacent the groove cooperating with the locking member flange portions.

A handle is mounted on the upper portion of the locking member above the top surface of the cover for rotating the locking member between its unlocked and locked positions. Preferably, the handle is of greater dimension than that of the central opening and of the locking member upper portion and is removably mounted on the locking member for assembly of the locking member into the cover from beneath the cover and subsequent assembly of the handle to the locking member from above the cover. The cover top surface may have a central recess and the handle may be pivotally movable between a vertical carrying position extending upwardly beyond the recess and a stored position within the recess.

For the purpose of fully describing the invention, reference is now made to the following detailed description of a preferred embodiment thereof, taken together with the accompanying drawings, wherein:

FIG. 1 is a perspective view of the closed and locked container assembly of the invention;

FIG. 2 is an exploded perspective view of the open and unlocked container assembly of the invention;

FIG. 3 is a sectional elevation of the closed and locked container assembly of FIG. 1, taken on line 3—3 of FIG. 1;

FIG. 4 is a sectional plan view of the closed and locked container assembly of FIG. 1, taken on line 4—4 of FIG. 3; and FIG. 5 is a partial sectional elevation of the closed and locked container assembly of FIG. 1, taken on line 5—5 of FIG. 3.

Referring to the drawings, the novel container assembly comprises a thermally insulated open top lower container, generally designated 10, having a bottom wall 12, end walls 14 and side walls 16. A peripheral generally planar top wall 18 defines the central top opening into lower container 10. The inner surfaces of side walls 16 have outwardly extending opposed grooves 20 spaced downwardly from and parallel to the plane of said top wall, said grooves having stop abutments 22 at one end thereof.

A cover, generally designated 24, is adapted to be aligned and releasably locked on top of lower container 10. Cover 24 is preferably integrally molded of elastically deformable organic plastic material, such as polyethylene, utilizing blow molding techniques, providing an integrally molded, hollow, one piece semi-rigid cover 24 having relatively thin walls for economy of manufacture and to provide an internal air space for thermal insulation. Cover 24 has a top wall 26 vertically spaced from its bottom wall 30, outer side walls 32 and end walls 34. A shallow handle recess 28 is provided in top wall 26.

Downwardly extending container aligning side walls 36 and end walls 38 are provided on cover bottom wall 30 spaced inwardly from cover outer side walls 32 and end walls 34. In the aligned position of cover 24 on top of lower container 10, the peripheral outer portion of cover bottom wall 30 is in contact with lower container peripheral top wall 18 and aligning walls 36 and 38 are in contact with the inner surfaces of container end and side walls 14 and 16.

Cover 24 also has an inner circular wall 40 with an inwardly extending retaining rib 42, said wall and rib defining a circular central opening 44 extending between cover top wall 26 and bottom wall 30. Also provided are a pair of opposed arcuate guiding side walls 29 concentric with inner circular wall 40 and extending downwardly from cover bottom wall 30, said walls 29 each having a stop abutment 31 at one end thereof.

A locking member, generally designated 46, is provided for releasably locking cover 24 on top of lower container 10. Locking member 46 is also preferably integrally molded of elastically deformable organic plastic material, such as polyethylene, utilizing blow molding techniques, providing an integrally molded, hollow, one piece semi-rigid locking member 24 having relatively thin walls for economy of manufacture and to provide an internal air space for thermal insulation. Locking member 46 is rotatably movable between unlocked and locked positions for releasably locking cover 24 in aligned position on lower container 10.

Locking member 46 has an upper circular mounting portion 48 having a circular retaining groove 50 and a lower portion having locking flanges 58. A pair of opposed handle recesses 52 are provided on opposite sides adjacent the upper end of mounting portion 48.

Upper circular locking member mounting portion 48 is rotatably mounted within cover central opening 44 and extends upwardly therethrough with handle recesses 52 above cover top wall 26 within its recess 28 and with its retaining groove 50 cooperating with retaining rib 42 on cover inner circular wall 40 to normally prevent relative axial movement of cover 24 and locking member 46, while providing snap-in assembly of locking member 46 and cover 24, as hereinafter more fully explained.

The lower portion of locking member 46 has a pair of opposed arcuate outer guiding walls 54 concentric with and in contact with cover guiding walls 29 and a pair of connecting side walls 56 which cooperate with cover stop abutments 31. Also provided on the lower portion of locking member 46 below walls 54 are a pair of opposed outwardly extending flanges 58 parallel to and spaced downwardly from cover bottom wall 30 for cooperating with bottom container opposed grooves 20 for locking cover 24 on top of container 10.

A C-shaped handle 60 for carrying container 10 assembled with cover 24 and for rotating locking member 46 between its locked and unlocked positions is pivotally mounted in locking member handle cylindrical recesses 52 by its opposed cylindrical ends 62. Handle 60 is also preferably integrally molded of elastically deformable organic plastic material, such as polyethylene, utilizing blow molding techniques, to provide an integral, hollow, one piece semi-rigid handle 60. Handle 60 is preferably of greater dimension than that of cover central opening 44 and of locking member upper mounting portion 48 to provide a comfortable carrying grip.

In order to assemble locking member 46 with cover 24, mounting portion 48 of locking member 46 is positioned beneath central opening 44 of cover 24 and is then forced into assembled position within opening 44 by elastically distorting central opening 44 and mounting portion 48, as by striking it a sharp blow to snap it into assembled position, with rib 42 on the inner circular wall 40 of cover 24 received within groove 50 of locking member 46 to normally prevent relative axial movement of cover 24 and locking member 46, while permitting their relative rotation. If desired, locking member 46 and cover 24 may be disassembled by applying reversed force.

Handle 60 is next mounted on locking member 46 from above cover 24 by bending handle 60 to open its opposed ends 62 sufficiently to be received within locking member recesses 52. After its release from bending force, it will be pivotally mounted on locking member 46 above top wall 26 of cover 24 at its central recess 28, with handle 60 pivotally movable between a vertical carrying position extending upwardly beyond recess 28 for convenient carrying, as shown in FIG. 5 and in dashed lines in FIG. 3, and a stored position within recess 28 to provide a flat top container assembly for convenient stacking, as shown in FIG. 1 and in solid lines in FIG. 3. If desired, handle 60 may be removed from locking member 60 by reversing its assembly.

To attach cover 24 assembled with locking member 46 and handle 60 to the top of container 10, handle 60 is rotated to its open position transverse to cover 24, as shown in FIG. 2 and in dashed lines in FIG. 5, to move locking member flanges 58 into a position parallel to cover 24, until further rotation of locking member 46 from an unlocked position in the direction opposite to its locking direction is prevented by the contact of locking member side walls 56 with cover stop abutments 31.

Cover 24 is then aligned with container 10 and inserted into it with its aligning walls 36 and 38 in contact with the inner surfaces of container end and side walls 14 and 16 and the peripheral outer portion of cover bottom wall 30 in contact with peripheral top wall 18 of container 10.

Handle 60 is then rotated to a longitudinal position with respect to cover 24, as shown in FIGS. 1, 3, 4 and 5, to move locking member flanges 58 for locking cover 24 and lower container 12 upon rotation of locking member 46 relatively to cover 24 and container 10 in a plane parallel to the plane of lower container peripheral top wall 18 and cover bottom wall 30 between an unlocked position with flanges 58 disengaged from grooves 20 and a locked position with flanges 58 received within container grooves 20 until they contact groove stops 22, preventing further rotation from its fully locked position in the locking direction.

Handle 60 may then be moved to its stored position within cover recess 28 to provide a flat top container assembly, as shown in FIG. 1, for convenient stacking.

Various modifications of the invention, within the spirit thereof and the scope of the appended claims, will occur to those skilled in the art.

What is claimed is:

1. A container assembly comprising an open top lower container having a bottom wall, end and side walls, and a peripheral top wall defining a central top opening, the inner surfaces of said side walls having outwardly extending opposed grooves spaced downwardly from and parallel to the plane of said top wall a cover adapted to be aligned and releasably locked on top of said lower container said cover having top and bottom surfaces with side and end surfaces extending therebetween and an inner circular surface defining a central opening extending between said cover top and bottom surfaces the peripheral outer portion of said cover bottom surface being in contact with said lower container peripheral top wall in the aligned position of said cover aligning means for aligning said cover on top of said container a locking member rotatably movable between unlocked and locked positions for releasably locking said cover in aligned position on top of said lower container said locking member having an upper circular mounting portion and a lower locking flange portion said upper circular locking member mounting portion being rotatably mounted within said cover central opening and extending upwardly therethrough, and said lower locking flange portion having a pair of opposed outwardly extending flanges parallel to and spaced downwardly from said cover bottom surface for cooperating with said bottom container opposed grooves for locking of said cover and said lower container upon rotation of said locking member relatively to said cover and container in a plane parallel to the plane of said lower container peripheral top wall and said cover bottom surface between an unlocked position with said flanges disengaged from said grooves and a locked position with said flanges received within said grooves retaining means for normally preventing relative axial movement of said cover and locking member, and a handle mounted on the upper portion of said locking member above said top surface of said cover for rotating said locking member between its unlocked and locked positions.

2. A container assembly as claimed in claim 1, wherein said inner circular surface defining said central opening has retaining means on its inner surface and said upper circular locking member mounting portion has retaining means on its outer surface cooperating with said cover inner circular surface retaining means for normally preventing relative axial movement of said cover and locking member.

3. A container assembly comprising an open top lower container having a bottom wall, end and side walls, and a peripheral top wall defining a central top opening, the inner surfaces of said side walls having outwardly extending opposed grooves spaced downwardly from and parallel to the plane of said top wall an integrally molded hollow cover of organic plastic material adapted to be aligned and releasably locked on top of said lower container said cover having vertically spaced top and bottom walls, outer side and end walls, downwardly extending aligning walls on said bottom wall spaced inwardly from said outer side and end walls and an inner circular wall defining a central opening extending between said cover top and bottom walls the peripheral outer portion of said cover bottom wall being in contact with said lower container peripheral top wall and said aligning walls being in contact with the inner surfaces of said container end and side walls in the aligned position of said cover a locking member rotatably movable between unlocked and locked positions for releasably locking said cover in aligned position on top of said lower container said locking member having an upper circular mounting portin and a lower locking flange portion said upper circular locking member mounting portion being rotatably mounted within said cover central opening and extending upwardly therethrough, and said lower locking flange portion having a pair of opposed outwardly extending flanges parallel to and spaced downwardly from said cover bottom surface for cooperating with said bottom container opposed grooves for locking said cover and said lower container upon rotation of said locking member relatively to said cover and container in a plane parallel to the plane of said lower container peripheral top wall and said cover bottom surface between an unlocked position with said flanges disengaged from said grooves and a locked position with said flanges received within said grooves said inner circular surface defining said central opening having retaining means on its inner surface and said upper circular locking member mounting portion having retaining means on its outer surface cooperating with said cover inner circular surface retaining means for normally preventing relative axial movement of said cover and locking member stop means for preventing further locking member rotation from its unlocked position in the direction opposite to its locking direction and further rotation from its locked position in said locking direction, and a handle mounted on the upper portion of said locking member above said top wall of said cover for rotating said locking member between its unlocked and locked positions.

4. A container assembly as claimed in claim 3 wherein said retaining means for normally preventing relative axial movement of said cover and locking member comprises cooperating circular groove and rib means on said cover and locking member circular walls providing snap-in assembly of said locking member within said cover central opening.

5. A container assembly as claimed in claim 1, 2, 3 or 4, wherein said handle is of greater dimension than that of said central opening and of said locking member upper portion and is removably mounted on said locking member for assembly of said locking member into said cover from beneath said cover and subsequent assembly of said handle to said locking member from above said cover.

6. A container assembly comprising an open top lower container having a bottom wall, end and side walls, and a peripheral top wall defining a central top opening, the inner surfaces of said side walls having outwardly extending opposed grooves spaced downwardly from and parallel to the plane of said top wall an integrally molded hollow cover of organic plastic material adapted to be aligned and releasably locked on top of said lower container said cover having vertically spaced top and bottom walls, outer side and end walls, downwardly extending aligning walls on said bottom wall spaced inwardly from said outer side and end walls and an inner circular wall defining a central opening extending between said cover top and bottom walls the peripheral outer portion of said cover bottom wall being in contact with said lower container peripheral top wall and said aligning walls being in contact with the inner surfaces of said container end and side walls in the aligned position of said cover an integrally molded hollow locking member of organic plastic material rotatably movable between unlocked and locked positions for releasably locking said cover in aligned position on top of said lower container said locking member having an upper circular mounting portion and a lower locking flange portion said upper circular locking member mounting portion being rotatably mounted within said cover central opening and extending upwardly therethrough, and said lower locking flange portion having a pair of opposed outwardly extending flanges parallel to and spaced downwardly from said cover bottom surface for cooperating with said bottom container opposed grooves for locking said cover and said lower container upon rotation of said locking member relatively to said cover and container in a plane parallel to the plane of said lower container peripheral top wall and said cover bottom surface between an unlocked position with said flanges disengaged from said grooves and a locked position with said flanges received within said grooves retaining means for normally preventing relative axial movement of said cover and locking member comprising cooperating circular groove and rib means on said cover and locking member circular walls providing snap-in assembly of said locking member within said cover central opening stop means for preventing further locking member rotation from its unlocked position in the direction opposite to its locking direction and further rotation from its locked position in said locking direction, and a handle mounted on the upper portion of said locking member above said top wall of said cover for rotating said locking member between its unlocked and locked positions, said handle being of greater dimension than that of said central opening and of said locking member upper portion and being removably mounted on said locking member for assembly of said locking member into said cover from beneath said cover and subsequent assembly of said handle to said locking member from above said cover.

7. A container assembly as claimed in claim 3, 4 or 6, wherein said stop means comprises abutment means on the bottom wall of said cover and adjacent said groove cooperating with said locking member flange portions.

8. A container assembly as claimed in claim 1, 3, or 6, wherein said cover top surface has a central recess and said handle is pivotally movable between a vertical carrying position extending upwardly beyond said recess and a stored position within said recess.

* * * * *